US005836632A

United States Patent [19]

Pompa

[11] Patent Number: 5,836,632

[45] Date of Patent: Nov. 17, 1998

[54] LOAD BALANCING LIFTING APPARATUS

[75] Inventor: Juan Rogelio Pompa, Houston, Tex.

[73] Assignee: Jerry M. Ball, So. Houston, Tex.

[21] Appl. No.: 902,256

[22] Filed: Jul. 29, 1997

[51] Int. Cl.[6] ..... B66C 1/12; B66D 3/04

[52] U.S. Cl. ..... 294/82.12; 254/390

[58] Field of Search ..... 294/67.21, 67.5, 294/74, 81.3, 81.4, 82.12, 86.41; 254/389, 390

[56] References Cited

U.S. PATENT DOCUMENTS

| | | | |
|---|---|---|---|
| 2,356,147 | 8/1944 | Caldwell | 294/82.12 |
| 2,629,625 | 2/1953 | Phillips | 294/82.12 X |
| 2,838,336 | 6/1958 | Archer | 294/82.12 |
| 4,097,083 | 6/1978 | Schwartz | 294/82.12 |
| 4,139,179 | 2/1979 | Kukulski | 294/82.12 X |
| 4,762,355 | 8/1988 | Hogg | 294/82.12 |

FOREIGN PATENT DOCUMENTS

| | | | |
|---|---|---|---|
| 1184787 | 10/1985 | U.S.S.R. | 294/82.12 |
| 1373669 | 2/1988 | U.S.S.R. | 294/82.12 |

*Primary Examiner*—Johnny D. Cherry
*Attorney, Agent, or Firm*—Bill B. Berryhill

[57] ABSTRACT

Apparatus for balancing and lifting a load supported from opposite ends of a cable or chain and which includes a sheave engageable by the cable or chain and through which extends a pin member. The pin member is radially offset from the center of the sheave and is supported, at opposite ends thereof, by structural members which may be attached to a source of lifting power.

8 Claims, 3 Drawing Sheets

LOAD BALANCING LIFTING APPARATUS

BACKGROUND OF THE INVENTION

1. Field of the Invention

The present invention pertains to rigging and lifting equipment. More specifically, the present invention pertains to apparatus for balancing and lifting a load supported from opposite ends of a cable or chain.

2. Description of the Prior Art

Rigging and lifting equipment are frequently used to lift pumps, motors, vessels, small buildings and other equipment in loading, unloading or transferring such items to a new location. In doing so, a lifting sling is typically fabricated including at least one cable or chain from opposite ends of which the load is supported. The hook from a crane or other lifting equipment would be attached to some midportion of the sling for lifting of the load.

The are two major problems in rigging and lifting equipment in this manner: 1) the location of the center of gravity of the load is typically not known and 2) the center of gravity of the load is not symmetrically located relative to the pick up points of the sling. Even when the weight and location of gravity of the load are known, the lifting slings typically require fabrication to different lengths. Thus, the slings may only be used for one lift, making them relatively expensive.

Another serious problem is safety. Chains with "come-alongs" are typically used in rigging and lifting to make length adjustments necessary for balancing loads. Come-alongs wear out and may become dangerous. Come-alongs also require field adjustments, while a load is suspended, exposing personnel to possible injury.

Thus, the rigging and lifting equipment of the prior art leaves much to be desired in effectively and safely balancing and lifting heavy loads. Obviously, improvements are needed.

SUMMARY OF THE PRESENT INVENTION

In the present invention, apparatus is disclosed for automatically balancing and lifting a load supported from opposite ends of a cable or chain. The apparatus of the present invention automatically adjusts for center of gravity of the load without having to provide slings of different lengths.

The apparatus of the present invention includes a sheave engageable by the cable or chain by which the load is being lifted. A pin member extends through the sheave and is supported at opposite ends thereof by structural members which may be attached to a source of power for lifting the load. The pin member is unique in that its central axis is offset from the center of the sheave. It is this arrangement which permits balancing and equalizing of the load at the opposite ends of the cable or chain.

The apparatus of the present invention automatically balances the load being supported from opposite ends of a cable or chain without requiring fabrication of different length slings and without requiring personnel to make adjustments while the load is being supported. Thus, the lift is made much more efficiently and in much greater safety. Many other objects and advantages of the invention will be apparent from reading the description which follows in conjunction with the accompanying drawings.

DESCRIPTION OF A PREFERRED EMBODIMENTS

Figure 1:
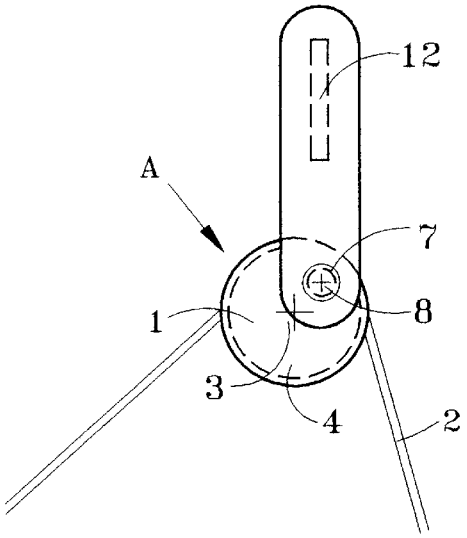
FIG. 1 is a side view of balancing and lifting apparatus of the present invention, according to a preferred embodiment thereof.
Figure 2:
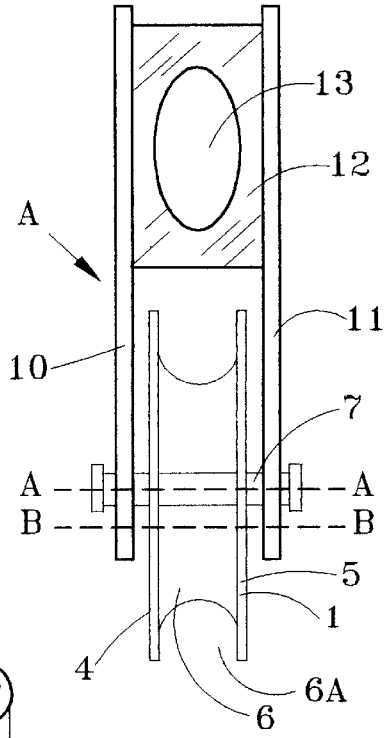
FIG. 2 is an end view of the balancing and lifting apparatus of the present invention, according to a preferred embodiment thereof.

Referring first to FIGS. 1 and 2 there is shown apparatus A of the present invention for balancing and lifting loads from opposite ends of cables and chains. The apparatus A comprises a sheave 1 which may be engageable by a cable or chain 2. The terms "cable or chain" as used herein are intended to include any type of long, slender, strong member to the ends of which a heavy load may be attached for lifting. This includes wire rope, hemp rope, and any rope, chain or cable of sufficient strength.

The center of the sheave is indicated at 3. Typically, the sheave 1 would include outer circular plates or flanges 4 and 5 separated by a hub 6 forming one or more cable receiving grooves 6*a*. The groove 6*a* would be at least wide enough to accept one cable and in some embodiments wide enough to receive a cable once wrapped around the sheave 1.

A pin member 7 extends through the sheave for support at opposite ends thereof by structural members 10 and 11. It will be noted that the center 8 and central axis a—a of the pin member 7 is offset from the center 3 and central axis b—b of the sheave 1. The fit between the pin member 7 and sheave 1 may be loose enough so that the sheave 1 may rotate on the pin 7. In other embodiments, the pin 7 and sheave 1 might be fixed together with the mounting of the pin 7 in holes provided in structural members 10 and 11 being loose enough to allow rotation of pin 7 relative to the structural members 10 and 11.

The structural members 10 and 11 may be connected transversely by a structural member 12, the straps 10 and 11 and the connecting structural member 12 then forming the block for the sheave 1. The connecting structural member 12 may be provided with a hole 13 for engagement by hooks or other lifting members as will be understood hereafter.

Figure 3:
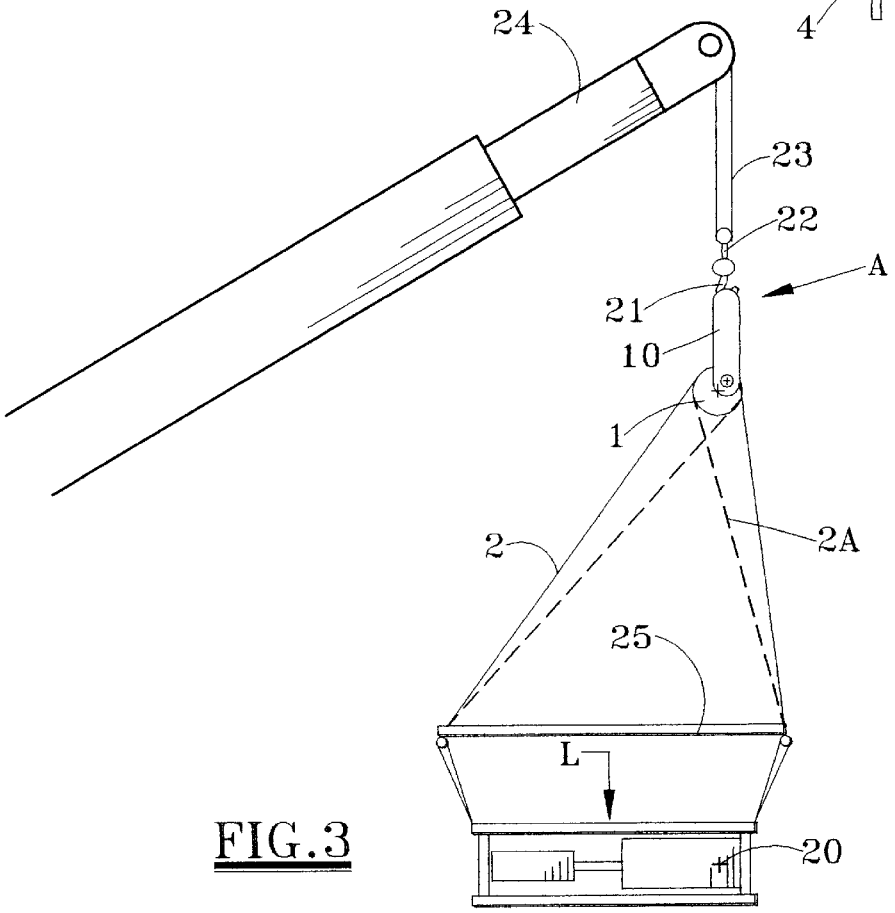
FIG. 3 is a pictorial representation of the balancing and lifting apparatus of the present invention of FIGS. 1 and 2 shown with other equipment in lifting a load supported from opposite ends of a cable or chain.

Referring now also to FIG. 3, the apparatus A of the present invention is shown in use for lifting a heavy load L such as a skid mounted engine and pump. For purposes of illustration, the center of gravity of the load L is assumed to be at the point 20. The apparatus A of the present invention is shown suspended from the hook 21, block 22, cable 23 of a crane arm 24. The crane to which the crane arm 24 is attached simply provides the power for lifting the load L. The cable 2 is shown engaged with the sheave 1 and the ends of the cable 2 are passed around the ends of a spreader bar or member 25 and then attached to opposite ends of the load L. As the crane arm 24 is lifted or the cable 23 shortened, the weight of the load L is eventually supported by the crane arm 24. As the load begins to be assumed by the apparatus A, the sheave 1 rotates about its pin 7 and the cable 2 shifts on the sheave 1 until the forces are equalized about a center line which corresponds with the center of gravity 20 of the load L, balancing the load L as it is lifted off the ground.

Figure 4:
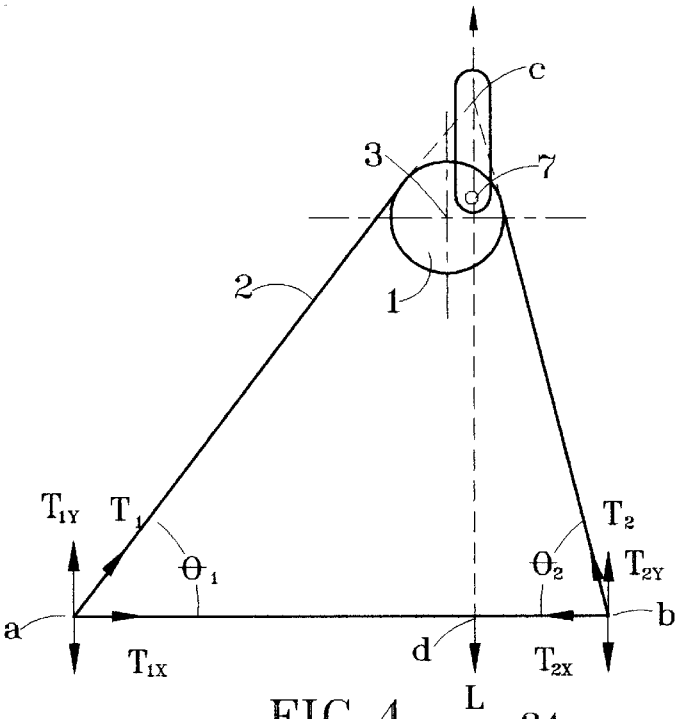
FIG. 4 is a force diagram illustrating the distribution of forces when lifting an unbalanced load, such as shown in FIG. 3, with the balancing and lifting apparatus of the present invention.

FIG. 4 is a force diagram which illustrates the force vectors and moments in the lift of a load L by the apparatus A of the present invention. For purposes of illustration it will be assumed that the load L is 20,000 pounds, the distance between lifting points a and b is 20 feet and the center of gravity for the load L (designated as point d) is 14 feet to the right of point a and 6 feet to the left of point b. Tension in the cable 2 will be referred to as $T_1$ and $T_2$. The horizontal (x) and vertical (y) force vectors of $T_1$ and $T_2$ will be referred to as $T_{1x}$, $T_{1y}$, and $T_{2x}$, $T_{2y}$, respectively.

For the load L to be in equilibrium, the sum of the vertical components $T_{1y}$ and $T_{2y}$ must equal 20,000 pounds. The sum of the horizontal components $T_{1x}$ and $T_{2x}$ must equal 0 and the summation of moments about any point must be 0; i.e.:

$$1.\ T_{1y} + T_{2y} = 20{,}000\ \#$$
$$2.\ T_{1x} - T_{2x} = 0$$
$$3.\ \Sigma M = (14\text{ ft.} \times 20{,}000\#) - (20\text{ ft.} \times T_{2y}) = 0$$
$$\text{Therefore } T_{2y} = \frac{14\text{ ft.}}{20\text{ ft.}} \times 20{,}000\# = 14{,}000\#$$
$$\text{and } T_{1y} = 20{,}000\# - T_{2y} = 6{,}000\#$$

The magnitude of horizontal components $T_{1x}$ and $T_{2x}$ (which equal each other) depends on angles of the cable or sling at points a and b. The sling angles also depend on total length of the sling. For purposes of calculation, points a, b and c (the point of equilibrium where $T_1$ and $T_2$ meet above sheave 1) will form a triangle abc. One angle $\Theta_1$ will be assumed from which the other angle $\Theta_2$ will be determined. Assuming angle $\Theta_1$ to be 45°, both legs ad and cd of the triangle adc are equal; i.e.:

$$ad = cd = 14\text{ ft.}$$

Then ac can be determined by the formula:

$$ac^2 = ad^2 + cd^2 = (14)^2 + (14)^2$$
$$ac = \sqrt{(14)^2 + (14)^2} = \sqrt{2\,(14)^2} = 14\sqrt{2}$$
$$ac = 19.80\text{ ft.}$$
$$db = ab - ad = 20\text{ ft.} - 14\text{ ft.} = 6\text{ ft.}$$

and $$cb^2 = db^2 - cd^2 = (6)^2 + (14)^2 = 36 + 196$$
$$cb = \sqrt{232} = 15.23\text{ ft.}$$

The other angle $\Theta_2$ can be found.

$$\tan \Theta_2 = \frac{14\text{ ft.}}{6\text{ ft.}} = 2.33$$
$$\Theta_2 = 66.8°$$

To find tension $T_1$ and $T_2$:

$$\sin 45° = \frac{T_{2x}}{T_1} = \frac{14\text{ ft.}}{19.8\text{ ft.}}$$
$$T_1 = T_{2x} \times \frac{19.8\text{ ft.}}{14\text{ ft.}}$$
$$T_1 = 6{,}000\# \times \frac{19.8\text{ ft.}}{14\text{ ft.}} = 8{,}485.7\#$$
$$\sin 66.8° = \frac{T_{2y}}{T_2} = \frac{14\text{ ft.}}{15.23\text{ ft.}}$$
$$T_2 = T_{2y} \times \frac{15.23}{14} = 14{,}000\# \times \frac{15.23}{14}$$
$$T_2 = 15{,}230.0\#$$

These calculations have made no mention of the apparatus A because the equilibrium equations must be met whether the apparatus A is used or not. The apparatus A does not change the equilibrium equations, it complies with them. The vector force diagram in the equilibrium, assuming the angles $\Theta_1$=45° and $\Theta_2$=66.8°, would have a lifting force at apparatus A of 20,000 pounds. $T_1$ would equal 8,485.7 pounds and $T_2$ would equal 15,230 pounds. Obviously, if a rolling or center mounted sheave were used, equilibrium would not be maintained because $T_2$ would overcome $T_1$ and the load would rotate with the rolling sheave. The vector force diagram is duplicated when the offset lifting block (10,11,12) automatically rotates so that all the forces act at a point and there is no tendency to rotate. The lifting block counters the tendency of ($T_2$–$T_1$) to make the sheave rotate.

Figure 5:
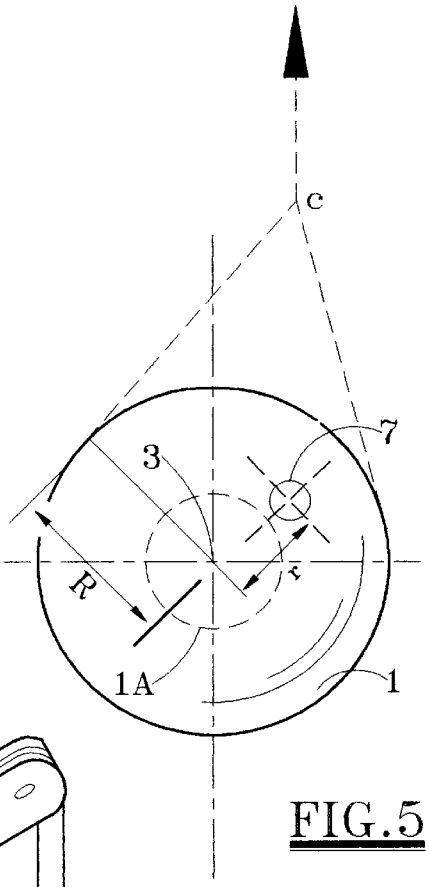
FIG. 5 is an enlarged detail of a portion of the force diagram of FIG. 4 showing the balancing and lifting apparatus of the present invention.

FIG. 5 shows the sheave portion of the force diagram of FIG. 4 on a greater scale. It also illustrates that the pin 7 is offset from the center 3 of sheave 1 by a distance r which is less than the radius R of sheave 1. However, it must be pointed out that the sheave could be designed so that the pin 7 would be offset from the center 3 of the sheave 1 by a distance greater than the radius of the portion of the sheave engaged by the cable. For example, the cable receiving groove (such as 6A in FIG. 2) might lie on a smaller circle, such as circle 1A as in FIG. 5.

Since $T_1$ and $T_2$ are usually not equal, one of the factors to consider in using the apparatus A of the present invention is friction, slippage and control of the cable or cables 2 in contact with the sheave 1. The diagrams of FIGS. 6 and 7 will illustrate this point. If the cable 2 is not wrapped around sheave 1, the cable 2 will frictionally engage the sheave 1 only through an angle which equals $\Theta_1+\Theta_2$ and is less than 180°. If the cable is wrapped once around the sheave, the angle of engagement will be increased by 360° ($\Theta_1+\Theta_2$+360 °). This will provide substantially more friction to prevent slippage. However, the additional wrap may be somewhat cumbersome in making adjustments with the crane from which the apparatus A is supported.

Figure 7:
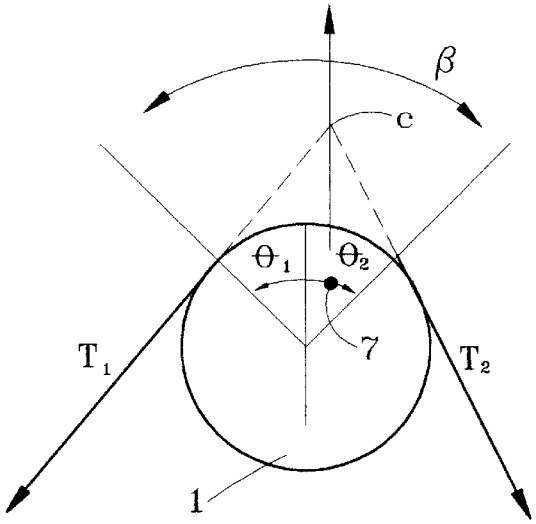
FIG. 7 is an enlargement of a portion of the diagram of FIG. 6.

For there to be no slippage, $T_2 < T_1\ e^{\mu\beta}$ where: e is 2.718 . . . , the base for natural logarithms; $\mu$ is the coefficient of friction between the cable and sheave (assume 0.2 for steel on steel); and $\beta$ is the angle, in radians, through which the cable engages the sheave. In the example of FIG. 7, without wrap and assuming $\Theta_1$=45°, $\Theta_2$=66.8°, $\pi$ radians=180°, $T_1$=8,485.7 # and $T_2$=15,230.0 #:

$$T_1e^{\mu\beta}=T_1e^{0.2(111.8°)}=T_1e^{0.2(0.621\pi)}=T_1e^{0.39}=1.48T_1=12{,}558.4\ \#$$

This is less than $T_2$, causing possible slippage.

In the example of FIG. 7, with a wrap:

$$T_1e^{\mu\beta}=T_1e^{0.2(471.8°)}=T_1e^{(0.2(2.621\pi)}=T_1e^{1.65}=5.21T_144{,}210.5\ \#$$

This is much greater than $T_2$ (no slippage but more cumbersome).

Figure 6:
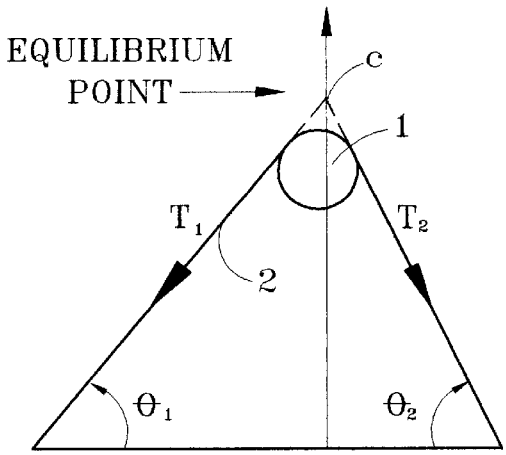
FIG. 6 is a simplified diagram for illustrating tension and the effects of frictional engagement of cables or chains utilized in lifting a load with the balancing and lifting apparatus of the present invention.
Figure 9:
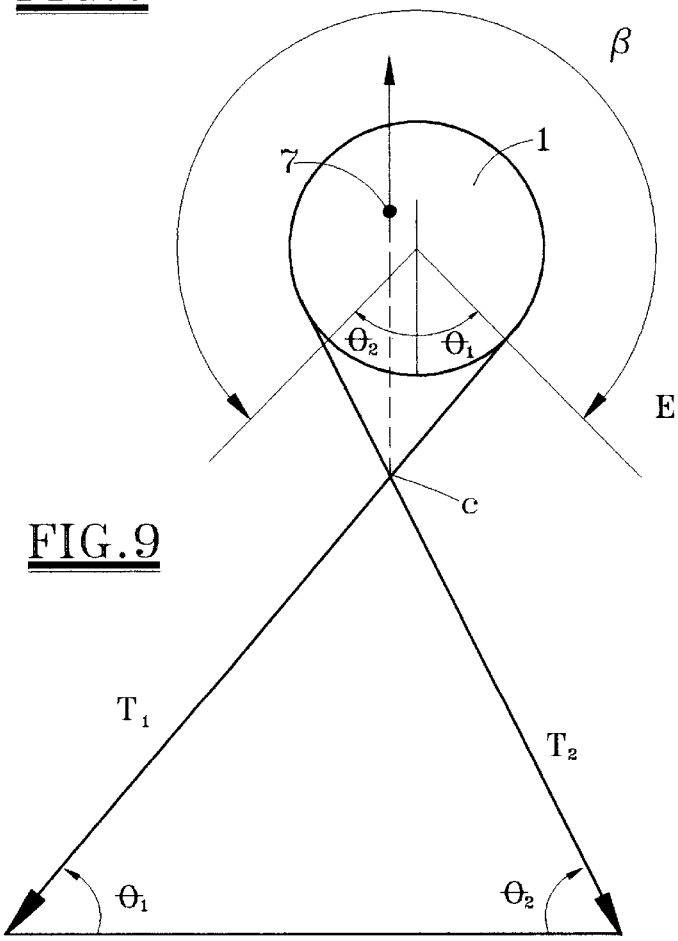
FIG. 9 is an enlargement of the diagram of FIG. 8.
Figure 8:
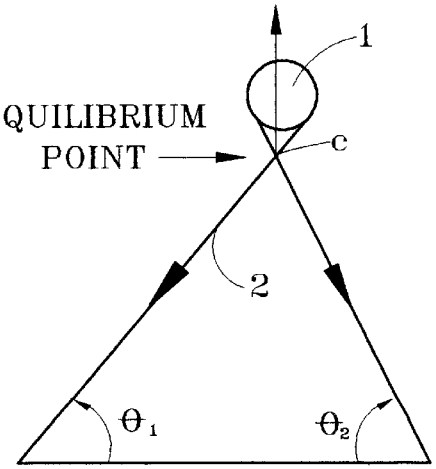
FIG. 8 is a simplified diagram for illustrating tension and the effects of frictional engagement of cables or chains utilized in lifting a load with the balancing and lifting apparatus of the present invention, the cables or chains being in an arrangement different than that of FIGS. 6 and 7.

FIGS. 8 and 9 illustrate an arrangement which will provide greater friction than the arrangement of FIGS. 6 and 7 with no wrap but less friction and more control (less cumbersome) than with a full wrap. In the arrangement of FIGS. 8 and 9 the opposite ends of cable or cables 2 cross each other and are connected to the lifted load at lifting points opposite the lifting points illustrated in FIGS. 6 and 7 or as in FIGS. 3 and 4. The dashed line representation of the cable 2A in FIG. 3 also illustrates the crossed arrangement of FIGS. 8 and 9.

In the crossed arrangement of FIGS. 8 and 9, β, the angle of cable contact with sheave 1, is equal to $360°-(\Theta_1+\Theta_2)$. This is more than 180° but not as great as a full wrap $(360°+\Theta_1+\Theta_2)$. However, it is enough to prevent slipping and should be less cumbersome or easier to adjust and control. For example:

$$T_1e^{\mu\beta}=T_1e^{0.2(248.2°)}=T_1e^{0.2(1.379\pi)}=T_1e^{0.87}=2.39T_1=20{,}280.8\ \#$$

In this arrangement the apparatus A is not altered in design. It is still balanced about the offset pin 7 of the sheave 1. However, the pin 7 will be above the point of equilibrium c rather than below it as in the arrangement of FIGS. 7 and 8.

Figure 10:
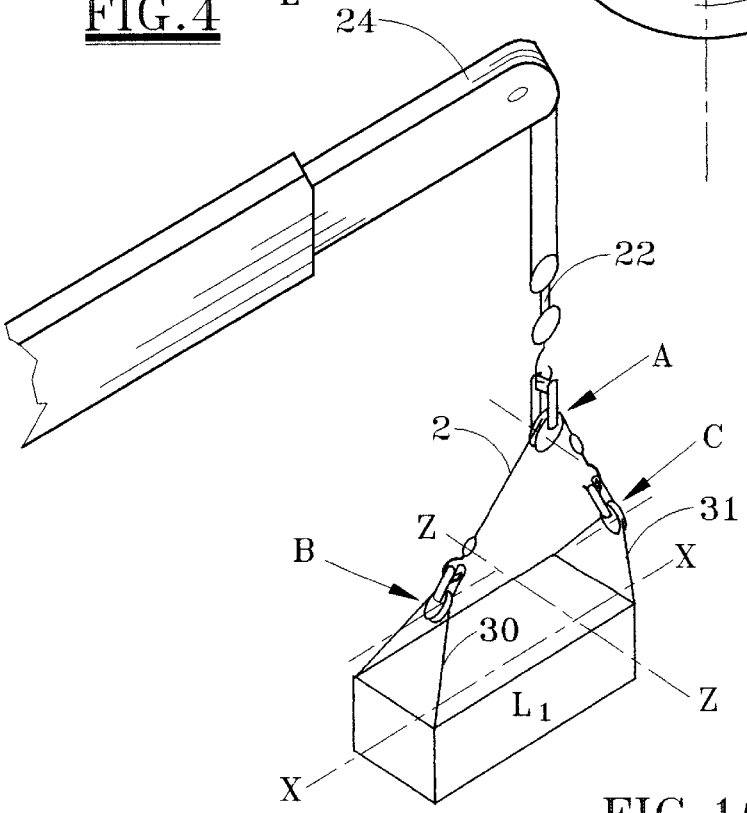
FIG. 10 is a pictorial representation of balancing and lifting apparatus of the present invention being utilized to lift an unbalanced load according to another embodiment of the invention.

Referring now to FIG. 10, there is shown another load $L_1$ being lifted by the crane arm 24 and crane block 22 attached to apparatus A such as the apparatus described with reference to FIGS. 1 and 2. The load $L_1$ has a longitudinal axis X—X and a transverse axis Z—Z. The center of sheave 1 of the apparatus A lies on an axis parallel with the axis of Z—Z. In this embodiment additional support assemblies similar to apparatus A are utilized. They will be referred to as first support assembly B and a second support assembly C. Each of the first and second support assemblies B, C includes a sheave, similar to the sheave 1 of apparatus A through which is inserted a pin member, such as the pin member 7 in apparatus A. The central axis of each pin is offset from the center of its corresponding sheave. Each of the sheaves of the assemblies B and C is engageable with center portions of second and third cables 30 and 31, which partially support, from the opposite ends thereof and transversely to the cable 2, the load $L_1$. Thus, the axes of the pins supporting the sheaves of support assembles B and C are parallel with the X—X axis of the load $L_1$. With this arrangement, the load $L_1$ may be balanced about its center of gravity in two planes, along two axes X—X and Z—Z.

As previously mentioned, the sheave 1 of the apparatus A of any of the embodiments of this invention described with reference to FIGS. 1–10 could be designed to receive one, two or more cables or chains. This allows an increase in the ratio D/d where:

D=sheave diameter d=diameter of the cables or chains.

The increased ratio of D/d reduces stress on the cables and the engagement surface of the sheave and helps prevent rotation about the vertical axis. Of course, the more cables or chains used, the less tension per cable or chain.

The apparatus of the present invention automatically balances a load being lifted or supported from opposite ends of a cable or chain. No special slings need to be designed. No field adjustments need to be made, eliminating the subjection of personnel to dangerous situations. The apparatus is relatively simple and is certainly less expensive and safer to operate than methods of the prior art.

Several preferred embodiments of the invention have been described herein. Several applications or methods of using the invention are described herein. However, many variations of the invention and its uses may be made by those skilled in the art without departing from the spirit of the invention. Accordingly, it is intended that the scope of the invention be limited only by the claims which follow.

I claim:

1. Apparatus for balancing and lifting a load supported from opposite ends of a first cable or chain, said apparatus comprising a first sheave engageable by said cable or chain and through which extends a pin member, the opposite ends of said pin member being supported by structural members which may be attached to a source of power for lifting said load; said apparatus being characterized in that the central axis of said pin member is radially offset from the center of said first sheave and in that first and second ends of said first cable or chain are connected to first and second support assemblies, each of which also includes a sheave through which is inserted a pin member the central axis of which is radially offset from the center of its corresponding sheave, each of said sheaves of said first and second support assemblies being engageable with a center portion of second and third cable or chains, respectively.

2. The apparatus of claim 1 in which said first sheave is rotatable on said pin member.

3. The apparatus of claim 1 in which said first sheave is not rotatable on said pin member but the ends of said pin member are rotatable relative to said structural members.

4. The apparatus of claim 1 in which the radius of said first sheave, where engaged by said cable or chain, is R, said central axis of said pin member being offset from said first sheave center by a distance of r which is less than R.

5. The apparatus of claim 1 in which the radius of said first sheave, where engaged by said first cable or chain, is R, said central axis of said pin member being offset from said first sheave center by a distance of r which is greater than R.

6. The apparatus of claim 1 in which said first cable or chain is wrapped about said first sheave at least one time to prevent slippage.

7. The apparatus of claim 1 in which said structural members comprise a pair of parallel straps connected by a transverse support member to form a sheave block.

8. The apparatus of claim 1 in which the opposite ends of said first cable or chain cross each other and are connected to said load so that said first cable or chain engages said first sheave through an angle of more than 180 degrees but less than 360 degrees.

* * * * *